US008887982B2

(12) United States Patent
Smith et al.

(10) Patent No.: US 8,887,982 B2
(45) **Date of Patent: *Nov. 18, 2014**

(54) HAND FORMED REINFORCED POLYGONAL CONTAINERS AND BLANKS FOR MAKING THE SAME

(75) Inventors: Kenneth Charles Smith, Hiram, GA (US); Craig W. Buscema, Lithia Springs, GA (US)

(73) Assignee: Rock-Tenn Shared Services, LLC, Norcross, GA (US)

( * ) Notice: Subject to any disclaimer, the term of this patent is extended or adjusted under 35 U.S.C. 154(b) by 461 days.

This patent is subject to a terminal disclaimer.

(21) Appl. No.: 12/945,274

(22) Filed: Nov. 12, 2010

(65) Prior Publication Data

US 2011/0056937 A1 Mar. 10, 2011

Related U.S. Application Data

(63) Continuation-in-part of application No. 12/256,051, filed on Oct. 22, 2008.

(60) Provisional application No. 61/051,302, filed on May 7, 2008.

(51) Int. Cl.

| | |
|---|---|
| ***B65D 5/28*** | (2006.01) |
| ***B31B 49/02*** | (2006.01) |
| ***B31B 1/26*** | (2006.01) |
| ***B65D 5/20*** | (2006.01) |
| ***B31B 3/00*** | (2006.01) |
| ***B65D 5/44*** | (2006.01) |
| ***B65D 5/22*** | (2006.01) |
| ***B65D 5/66*** | (2006.01) |

(52) U.S. Cl.

CPC ..... *B65D 5/6664* (2013.01); *B65D 5/443* (2013.01); *B65D 5/22* (2013.01); *B31B 3/00* (2013.01); *Y10S 229/919* (2013.01)

USPC ..... 229/109; 229/117.13; 229/919

(58) Field of Classification Search

CPC .... B65D 5/443; B65D 5/0045; B65D 5/6632; B65D 5/002; B65D 5/2033; B65D 2571/00895; B65D 5/001; B31B 2203/105

USPC ..... 229/109, 192, 918, 177, 179

See application file for complete search history.

(56) References Cited

U.S. PATENT DOCUMENTS

| | | | | |
|---|---|---|---|---|
| 3,034,698 | A | | 5/1962 | Forrer |
| 3,883,067 | A | * | 5/1975 | McGlynn et al. ..... 229/177 |
| 3,952,634 | A | | 4/1976 | Rollins et al. |
| 4,056,223 | A | | 11/1977 | Williams |

(Continued)

*Primary Examiner* — Gary Elkins
*Assistant Examiner* — Christopher Demeree
(74) *Attorney, Agent, or Firm* — Armstrong Teasdale LLP

(57) ABSTRACT

A blank of sheet material for forming a polygonal container includes a bottom panel, two opposing side panels each extending from a side edge of the bottom panel, and two opposing end panels each extending from an end edge of the bottom panel. The blank also includes a foldover panel that is configured to lock the container in at least a partially formed position. The blank further includes a reinforcing panel assembly that includes an outer reinforcing corner panel extending from the first side panel, an outer reinforcing end panel extending from the outer reinforcing corner panel, an inner reinforcing end panel extending from the outer reinforcing end panel, an inner reinforcing corner panel extending from the inner reinforcing end panel, and an inner reinforcing side panel extending from the inner reinforcing corner panel.

25 Claims, 3 Drawing Sheets

(56) References Cited

U.S. PATENT DOCUMENTS

| | | | | |
|---|---|---|---|---|
| 4,139,146 | A | | 2/1979 | Bamburg et al. |
| 4,235,364 | A | | 11/1980 | Baker |
| 4,621,766 | A | | 11/1986 | McClure |
| 4,624,653 | A | | 11/1986 | McBride et al. |
| 4,674,998 | A | | 6/1987 | Benedicenti |
| 4,676,428 | A | | 6/1987 | McClure |
| 4,676,429 | A | | 6/1987 | Crowe et al. |
| 4,792,084 | A | | 12/1988 | Dreeszen |
| 5,000,377 | A | | 3/1991 | McClure |
| 5,002,224 | A | | 3/1991 | Muise |
| 5,125,567 | A | | 6/1992 | McClure |
| 5,139,195 | A | | 8/1992 | McClure |
| 5,207,375 | A | | 5/1993 | McClure |
| 5,261,594 | A | | 11/1993 | Brown et al. |
| 5,285,956 | A | | 2/1994 | Piepho |
| 5,289,970 | A | | 3/1994 | McClure |
| 5,289,971 | A | | 3/1994 | McClure |
| 5,295,631 | A | | 3/1994 | McClure |
| 5,372,569 | A | | 12/1994 | Ballos, III |
| 5,487,504 | A | | 1/1996 | Baird |
| 5,535,941 | A | | 7/1996 | Garza |
| 5,588,585 | A | | 12/1996 | McClure |
| 5,673,848 | A | * | 10/1997 | Garza ..... 229/191 |
| 5,687,902 | A | * | 11/1997 | Tusing et al. ..... 229/198.1 |
| 5,807,225 | A | | 9/1998 | Nowacki et al. |
| 5,996,885 | A | | 12/1999 | Chu |
| 6,367,690 | B1 | | 4/2002 | McClure |
| 6,402,020 | B1 | | 6/2002 | McClure |
| 6,575,356 | B2 | | 6/2003 | McClure |
| 6,595,411 | B2 | | 7/2003 | McClure |
| 6,651,875 | B2 | * | 11/2003 | Chu ..... 229/191 |
| 7,152,777 | B2 | | 12/2006 | McClure |
| 7,207,473 | B2 | | 4/2007 | Fry |
| 7,290,696 | B2 | | 11/2007 | McClure |
| 7,458,503 | B2 | | 12/2008 | Fry |
| 7,470,225 | B2 | | 12/2008 | Herrin |
| 7,628,313 | B2 | | 12/2009 | Fry |
| 7,677,434 | B2 | | 3/2010 | Fry |
| 2005/0067478 | A1 | | 3/2005 | McClure |
| 2007/0000985 | A1 | | 1/2007 | McClure |
| 2007/0000986 | A1 | | 1/2007 | McClure |
| 2008/0000784 | A1 | | 1/2008 | McClure |
| 2009/0277952 | A1 | | 11/2009 | Smith |
| 2009/0280973 | A1 | | 11/2009 | Graham et al. |

* cited by examiner

HAND FORMED REINFORCED POLYGONAL CONTAINERS AND BLANKS FOR MAKING THE SAME

CROSS REFERENCE TO RELATED APPLICATIONS

This application is a continuation-in-part of U.S. patent application Ser. No. 12/256,051, filed Oct. 22, 2008, which claims the benefit of U.S. Provisional Application No. 61/051,302, filed May 7, 2008, the contents, including the figures, of which are hereby incorporated by reference in their entireties.

BACKGROUND OF THE INVENTION

The field of the invention relates generally to a blank and a reinforced polygonal container formed from the blank and more particularly, to a reinforced polygonal container that is hand formed from a blank for transporting a product stored within the container.

Containers are frequently utilized to store and aid in transporting products. These containers can be square, hexagonal, or octagonal. The shape of the container can provide additional strength to the container. For example, octagonal-shaped containers provide greater resistance to bulge over conventional rectangular, square or even hexagonal-shaped containers. An octagonal-shaped container may also provide increased stacking strength.

In at least some known cases, a blank of sheet material is used to form a container for transporting a product. More specifically, these known containers are formed by a machine that folds a plurality of panels along fold lines and secures these panels with an adhesive. Such containers may have certain strength requirements for transporting products. These strength requirements may include a stacking strength requirement such that the containers can be stacked on one another during transport without collapsing. To meet these strength requirements, at least some known containers include reinforced corners or side walls for providing additional strength including stacking strength. In at least some known embodiments, additional panels may be placed in a face-to-face relationship with another corner panel or side wall. However, it is difficult to form a container from a single sheet of material that includes multiple reinforcing panels along the corner and side walls. Further, it is increasingly difficult to form such a container by hand in the field, that is, without any machinery, and with little to no adhesive.

Machinery needed to quickly form and glue reinforced containers can require a substantial capital investment. Moreover, these machines can be costly to run and difficult to maintain, especially when the containers are being formed in the field for transporting agricultural products. In these agricultural applications, these machines are almost impractical to use. Accordingly, a need exists for a multi-sided reinforced container that is easily formed by hand from a single blank with little or no adhesive.

BRIEF DESCRIPTION OF THE INVENTION

In one aspect, a blank of sheet material for forming a polygonal container is provided. The blank includes a bottom panel, two opposing side panels each extending from a side edge of the bottom panel, and two opposing end panels each extending from an end edge of the bottom panel. The blank also includes a first foldover panel extending from a top edge of a first end panel of the two end panels. The first foldover panel is configured to lock the container in at least a partially formed position. The blank also includes a reinforcing panel assembly extending from a first side edge of a first side panel of the two side panels. The reinforcing panel assembly includes an outer reinforcing corner panel extending from the first side edge of the first side panel, an outer reinforcing end panel extending from a side edge of the outer reinforcing corner panel, an inner reinforcing end panel extending from a side edge of the outer reinforcing end panel, an inner reinforcing corner panel extending from a side edge of the inner reinforcing end panel, and an inner reinforcing side panel extending from a side edge of the inner reinforcing corner panel.

In another aspect, a polygonal container formed from a blank of sheet material is provided. The container includes a bottom wall, two opposing side walls where each side wall emanates from a side edge of the bottom wall, two opposing end walls where each end wall includes an end panel and a foldover panel, and a first reinforcing panel assembly. Each end wall emanates from an end edge of the bottom wall. Each foldover panel is opposite to the end edge and is configured to lock the container in at least a partially formed position. The first reinforcing panel assembly extends between a first end wall of the two end walls and a first side wall of the two side walls. The first reinforcing panel assembly includes a corner panel and an inner reinforcing corner panel at least partially overlying the corner panel.

In yet another aspect, a method for forming a polygonal container from a blank of sheet material is provided. The container has at least five sides including a bottom panel, two opposing side panels each extending from a side edge of the bottom panel, and two opposing end panels each extending from an end edge of the bottom panel. The container also includes a first foldover panel extending from a top edge of a first end panel of the two end panels, and a reinforcing panel assembly extending from a first side edge of a first side panel of the two side panels. The reinforcing panel assembly includes an outer reinforcing corner panel extending from the first side edge of the first side panel, an outer reinforcing end panel extending from a side edge of the corner panel, an inner reinforcing end panel extending from a side edge of the outer reinforcing end panel, an inner reinforcing corner panel extending from a side edge of the inner reinforcing end panel, and an inner reinforcing side panel extending from a side edge of the inner reinforcing corner panel. The method includes rotating the inner reinforcing end panel toward an interior surface of the outer reinforcing end panel about a fold line connecting the inner reinforcing end panel and the outer reinforcing end panel. The outer reinforcing end panel includes a first cutout defined along a top edge thereof, and the inner reinforcing end panel includes a second cutout defined along a top edge thereof. The outer and inner reinforcing end panels are positioned in a substantially face-to-face relationship with the first cutout and the second cutout aligned to form a locking slot. The method also includes rotating the outer and inner reinforcing end panels toward an interior surface of the first side panel about a fold line connecting the inner reinforcing end panel and the inner reinforcing corner panel and about a fold line connecting the outer reinforcing end panel and the outer reinforcing corner panel. The method further includes rotating the outer reinforcing corner panel and the inner reinforcing corner panel toward the interior surface of the first side panel about a fold line connecting the inner reinforcing corner panel and the inner reinforcing side panel and about a fold line connecting the outer reinforcing corner panel and the first side panel. The method also includes rotating the first side panel inwardly into a substantially perpendicular relationship with the bottom panel about a fold line connecting the first side panel and the bottom panel such that the first side panel and inner side panel form a first side wall of the polygonal container and the outer reinforcing corner panel and the inner reinforcing corner panel form a first corner wall of the polygonal container.

In another aspect, a method for forming a polygonal container from a blank of sheet material is provided. The polygonal container includes eight walls. The blank includes a bottom panel, two opposing side panels each extending from a side edge of the bottom panel, two opposing end panels each extending from an end edge of the bottom panel, a first foldover panel extending from a top edge of a first end panel of the two end panels, a second foldover panel extending from a top edge of a second end panel of the two end panels, and a pair of reinforcing panel assemblies extending from opposing side edges of each of the two opposing side panels for forming reinforced corners. The method comprises: (a) forming each of the reinforced corners including four corner walls from the reinforcing panel assemblies, wherein each of the reinforced corners includes a locking slot, (b) rotating the side panels inwardly into a substantially perpendicular relationship with the bottom panel for forming the side walls, (c) rotating the end panel inwardly into a substantially perpendicular relationship with the bottom panel for forming the end walls, (d) positioning the locking slots adjacent to the end walls, (e) rotating the first and second foldover panels inwardly in at least a partially overlying relationship with at least one of the reinforcing panel assemblies, wherein each of the foldover panels includes a pair of hinge tabs, and (f) inserting the hinge tabs of the foldover panels into the locking slots to lock the container in a formed position.

DETAILED DESCRIPTION OF THE INVENTION

The following detailed description illustrates the disclosure by way of example and not by way of limitation. The description clearly enables one skilled in the art to make and use the disclosure, describes several embodiments, adaptations, variations, alternatives, and use of the disclosure, including what is presently believed to be the best mode of carrying out the disclosure.

The present invention provides a stackable, reinforced container formed from a single sheet of material, and a method for constructing the container. The container is sometimes referred to as a reinforced mitered tray or a reinforced eight-sided tray, or a hand-formed tray-8. The container may be manually constructed, that is, hand-formed, from a blank of sheet material. In one embodiment, the container is fabricated from a cardboard material. The container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

In an example embodiment, the container includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. "Printing," "printed," and/or any other form of "print" as used herein may include, but is not limited to including, ink jet printing, laser printing, screen printing, giclée, pen and ink, painting, offset lithography, flexography, relief print, rotogravure, dye transfer, and/or any suitable printing technique known to those skilled in the art and guided by the teachings herein provided. In another embodiment, the container is void of markings, such as, without limitation, indicia that communicates the product, a manufacturer of the product and/or a seller of the product.

In the example embodiment, the container is erected by hand and locked into the erect or formed position without the use of any adhesive or glue. In an alternative embodiment, the container is erected into an erect position with a minimum amount of glue or adhesive.

Figure 1:
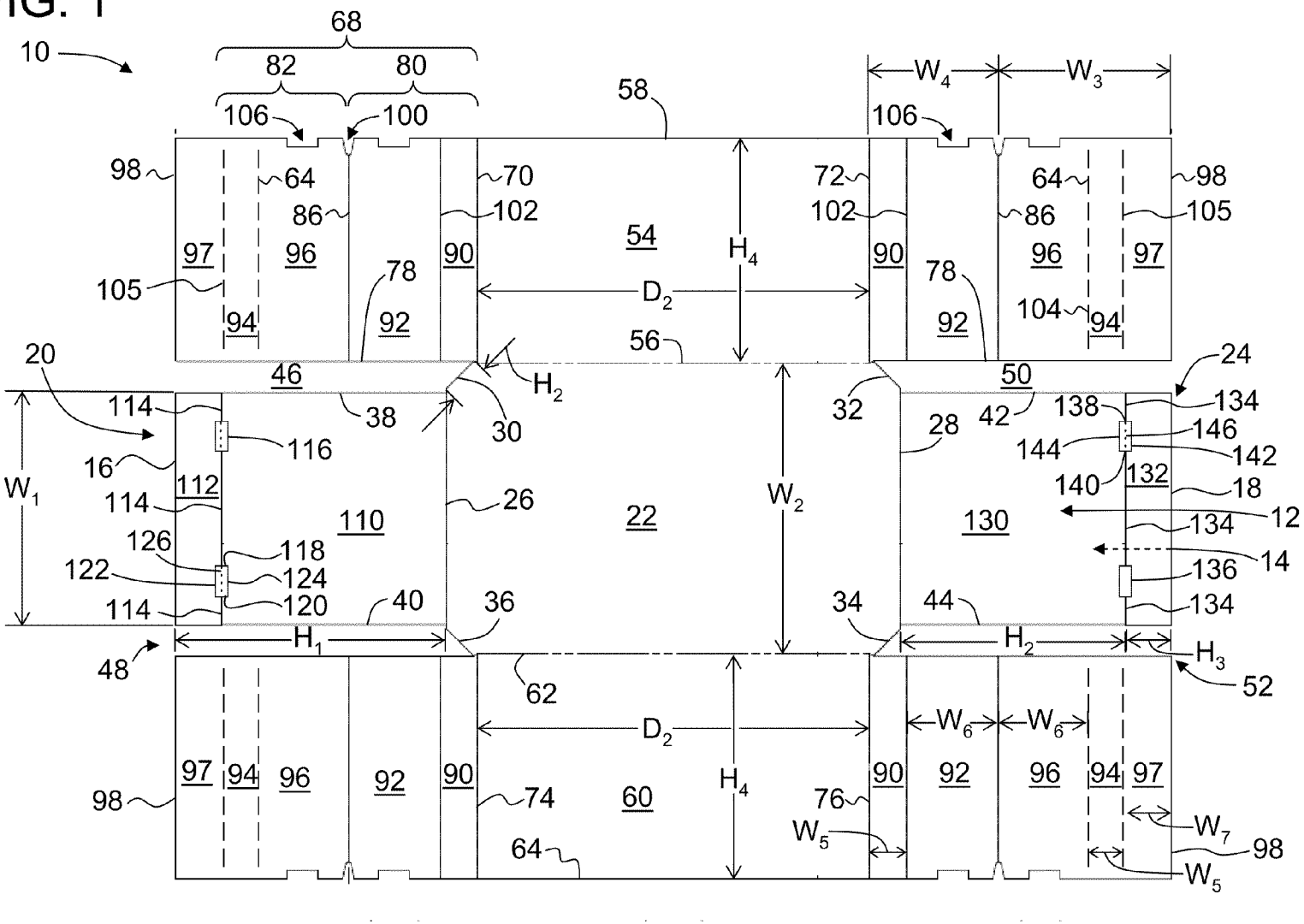
FIG. 1 is a top plan view of a blank of sheet material for constructing a container according to a first embodiment of the present invention.

Referring now to the drawings, and more specifically to FIG. 1, which is a top plan view of an example embodiment of a blank 10 of sheet material. A container 150 (shown in FIG. 2) is formed from blank 10. Blank 10 has a first or interior surface 12 and an opposing second or exterior surface 14. Further, blank 10 defines a leading edge 16 and an opposing trailing edge 18. In one embodiment, blank 10 includes, in series from leading edge 16 to trailing edge 18, a front panel assembly 20, a bottom panel 22, and a rear panel assembly 24, coupled together along preformed, generally parallel, fold lines 26 and 28, respectively. Front panel assembly 20 and rear panel assembly 24 are also considered to be end panel assemblies. The container formed from blank 10 may be referred to as an open-top reinforced mitered tray and/or a hand-formed tray-8 container.

More specifically, front panel assembly 20 extends from leading edge 16 to fold line 26, bottom panel 22 extends from front panel assembly 20 along fold line 26, and rear panel assembly 24 extends from bottom panel 22 along fold line 28 to trailing edge 18. Fold lines 26 and/or 28, as well as other fold lines and/or hinge lines described herein, may include any suitable line of weakening and/or line of separation known to those skilled in the art and guided by the teachings herein provided. Front and rear panel assemblies 20 and 24, respectively, may be considered to be end panels. When container 150 is formed from blank 10, fold line 26 defines a bottom edge of front panel assembly 20 and a front edge, or first end edge, of bottom panel 22, and fold line 28 defines a rear edge, or second end edge, of bottom panel 22 and a bottom edge of rear panel assembly 24. As used through this description, front edges and rear edges are also considered to be end edges.

Front panel assembly 20 and rear panel assembly 24 are substantially congruent and have a rectangular shape. Bottom panel 22 has an octagonal shape. More specifically, front panel assembly 20 and rear panel assembly 24 have a width $W_1$. Bottom panel 22 has a width $W_2$, which is longer that width $W_1$. Alternatively, width $W_1$ is substantially equal to or longer than width $W_2$. Further, in the exemplary embodiment, front and rear panel assemblies 20 and 24, respectively, have a first height $H_1$, and bottom panel 22 has a first depth $D_1$ that is larger than first height $H_1$. In an alternative embodiment, height $H_1$ is substantially equal to or larger than depth $D_1$. In the exemplary embodiment, front panel assembly 20, rear panel assembly 24, and/or bottom panel 22 are equally dimensioned, however, front panel assembly 20, rear panel assembly 24, and/or bottom panel 22 may be other than equally dimensioned.

In the exemplary embodiment, bottom panel 22 may be considered to be substantially rectangular in shape with four cut-off corners or angled edges 30, 32, 34, and 36 formed by cut lines. As such, the cut-off corner edges of otherwise rectangular bottom panel 22 define an octagonal shape of bottom panel 22. Moreover, each angled corner edge 30, 32, 34, and 36 has a length $L_1$, and angled edges 30 and 34 and angled edges 32 and 36 are substantially parallel. Alternatively, bottom panel 22 has any suitable shape that enables container 150 to function as described herein. For example, bottom panel 22 may be in the shape of a rectangle having corners that are truncated by a segmented edge such that bottom panel 22 has more than eight sides. In another example, bottom panel 22 may be in the shape of a rectangle having corners that are truncated by an arcuate edge such that bottom panel 22 has four substantially straight sides and four arcuate sides.

In the exemplary embodiment, front panel assembly 20 includes two free side edges 38 and 40, and rear panel assembly 24 includes two free side edges 42 and 44. Side edges 38, 40, 42, and 44 are substantially parallel to each other. Alternatively, side edges 38, 40, 42, and/or 44 are other than substantially parallel. In the exemplary embodiment, each side edge 38, 40, 42, and 44 is connected to a respective angled edge 30, 32, 34, or 36. Each side edge 38, 40, 42, and 44 may be directly connected to a respective angled edge 30, 32, 34, or 36 or, as shown in FIG. 1, may be slightly offset from a respective angled edge 30, 32, 34, or 36 to facilitate forming container 150 from blank 10 by allowing clearance for a thickness of a panel that is directly or indirectly attached to front panel assembly 20 or rear panel assembly 24. Side edges 38, 40, 42, and 44 and angled edges 30, 32, 34, and 36 partially define a respective cutout 46, 48, 50, or 52. More specifically, side edge 38 and angled edge 30 partially define cutout 46, side edge 42 and angled edge 32 partially define cutout 50, side edge 44 and angled edge 34 partially define cutout 52, and side edge 40 and angled edge 36 partially define cutout 48.

A first side panel 54 extends from bottom panel 22 along a fold line 56 to a free edge 58, and a second side panel 60 extends from bottom panel 22 along a fold line 62 to a free edge 64. Fold line 56 defines a bottom edge of first side panel 54 and a side edge of bottom panel 22, and fold line 62 defines a bottom edge of second side panel 60 and a side edge of bottom panel 22. First and second side panels 54 and 60 are each generally rectangularly shaped. Side panels 54 and 60 each have a depth $D_2$ that is shorter than depth $D_1$ such that side panels 54 and 60 are narrower than bottom panel 22. In the exemplary embodiment, fold line 56 extends between ends of angled corner edges 30 and 32, and fold line 62 extends between ends of angled corner edges 34 and 36. Further, in the exemplary embodiment, blank 10 does not include finger cutouts that may facilitate handling of container 150. In an alternative embodiment, at least one oval shaped finger cutout (not shown) is defined within first and second side panels 54 and 60. Alternatively, any number of finger cutouts may be of any shape and/or defined within any suitable panel such that handling of container 150 is facilitated.

In the exemplary embodiment, a reinforcing panel 68 extends from side edges of each side panel 54 and 60. Reinforcing panel 68 is also referred to herein as a reinforcing panel assembly that includes a plurality of panels as described in more detail herein. Each side edge is defined by a respective fold line 70, 72, 74, or 76. Fold lines 70, 72, 74, and 76 are substantially parallel to each other. Alternatively, fold lines 70, 72, 74, and/or 76 are other than substantially parallel. In the exemplary embodiment, each reinforcing panel 68 includes a free bottom edge 78. Each free bottom edge 78 at least partially defines cutouts 46, 48, 50, and 52. As such, one side edge 38, 40, 42, or 44, a respective angled edge 30, 36, 32, or 34, and a bottom edge 78 of an adjacent reinforcing panel 68 defines cutouts 46, 48, 50, and 52. Further, each reinforcing panel 68 is substantially similar and includes an outer reinforcing panel assembly 80 and an inner reinforcing panel assembly 82 connected along fold line 86. Fold line 86 defines a side edge of outer reinforcing panel assembly 80 and a side edge of inner reinforcing panel assembly 82. Moreover, outer reinforcing panel assembly 80 includes an outer reinforcing corner panel 90 and an outer reinforcing end panel 92; and inner reinforcing panel assembly 82 includes an inner reinforcing corner panel 94, an inner reinforcing end panel 96, and an inner reinforcing side panel 97.

More specifically, outer reinforcing panel assembly 80 extends along each of fold lines 70, 72, 74, and 76. Further, inner reinforcing panel assembly 82 extends from each outer reinforcing panel assembly 80 along fold line 86 to a free edge 98. A notch 100 is formed along fold line 86 between inner reinforcing panel assemblies 82 and outer reinforcing panel assemblies 80. Inner reinforcing panel assemblies 82 and outer reinforcing panel assemblies 80 are substantially rectangular in shape. More specifically, inner reinforcing panel assemblies 82 have a width $W_3$, and outer reinforcing panel assemblies 80 have a width $W_4$.

Each outer reinforcing panel assembly 80 includes a fold line 102 that divides each outer reinforcing panel assembly 80 into outer reinforcing corner panel 90 and outer reinforcing end panel 92. Fold line 102 defines an edge of outer reinforcing corner panel 90 and a side edge of outer reinforcing end panel 92, and fold line 86 defines a side edge of outer reinforcing end panel 92. In the exemplary embodiment, corner panel 90 and end panel 92 are substantially rectangular. Further, in the exemplary embodiment, each inner reinforcing panel assembly 82 includes fold lines 104 and 105 that divide each inner reinforcing panel assembly 82 into inner reinforcing corner panel 94, inner reinforcing end panel 96, and inner reinforcing side panel 97. Specifically, fold line 104 defines an edge of inner reinforcing corner panel 94 and a side edge of inner reinforcing end panel 96, and fold line 105 defines a side edge of inner reinforcing corner panel 94 and inner reinforcing side panel 97.

In the exemplary embodiment, inner reinforcing corner panel 94, inner reinforcing end panel 96, and inner reinforcing side panel 97 are substantially rectangular. Further, outer reinforcing corner panel 90 and inner reinforcing corner panel 94 are substantially congruent, and outer and inner reinforcing end panels 92 and 96, respectively, are substantially congruent. Moreover, outer and inner reinforcing end panels 92 and 96, respectively, each define a cutout 106, wherein cutouts 106 are positioned equidistantly from fold line 86.

Front panel assembly 20 includes a first end panel 110 coupled to bottom panel 22 at fold line 26. Front panel assembly 20 also includes a first foldover panel 112 coupled to first end panel 110 at a fold line 114 having a plurality of cut lines. Front panel assembly 20 also includes a plurality of first hinge tabs 116. First hinge tabs 116 are defined by cut lines 118 and 120 and fold lines 122 and 124. Cut lines 118 and 120 are substantially perpendicular to leading edge 16, and fold lines 122 and 124 are substantially parallel to leading edge 16.

Each of first hinge tabs 116 is substantially rectangular and includes at least a portion of first end panel 110 and first foldover panel 112. Therefore, hinge tabs 116 couple first end panel 110 to first foldover panel 112. In the exemplary embodiment, front panel assembly 20 includes two first hinge tabs 116. Alternatively, front panel assembly 20 includes any number of first hinge tabs 116. Also, in the exemplary embodiment, fold line 114 is oriented to define a bisecting line 126 through each of first hinge tabs 116 such that hinge tabs 116 include approximately 50% first end panel 110 and 50% first foldover panel 112. Alternatively, fold line 114 is oriented to define any line 126 through each of first hinge tabs 116 such that hinge tabs 116 include any proportions of first end panel 110 and first foldover panel 112.

Rear panel assembly 24 includes a second end panel 130 coupled to bottom panel 22 at fold line 28. Rear panel assembly 24 also includes a second foldover panel 132 coupled to second end panel 130 at a fold line 134 having a plurality of cut lines. Rear panel assembly 24 also includes a plurality of second hinge tabs 136. Second hinge tabs 136 are defined by cut lines 138 and 140 and fold lines 142 and 144. Cut lines 138 and 140 are substantially perpendicular to leading edge 18, and fold lines 142 and 144 are substantially parallel to leading edge 18. Each of second hinge tabs 136 is substantially rectangular and includes at least a portion of second end panel 130 and second foldover panel 132. Therefore, hinge tabs 136 couple second end panel 130 to second foldover panel 132. In the exemplary embodiment, rear panel assembly 24 includes two second hinge tabs 136. Alternatively, rear panel assembly 24 includes any number of second hinge tabs 136. Also, in the exemplary embodiment, fold line 134 is oriented to define a bisecting line 146 through each of second hinge tabs 136 such that hinge tabs 136 include approximately 50% second end panel 130 and 50% second foldover panel 132. Alternatively, fold line 134 is oriented to define any line 146 through each of second hinge tabs 136 such that hinge tabs 136 include any proportions of second end panel 130 and second foldover panel 132.

Each outer reinforcing corner panel 90 and each inner reinforcing corner panel 94 have a width $W_5$ that is substantially equal to length $L_1$. In addition, each outer reinforcing end panel 92 and inner reinforcing end panel 96 have a width $W_6$ that is greater than width $W_5$. In an alternative embodiment, width $W_6$ is approximately equal to width $W_5$. Further, in the exemplary embodiment, each inner reinforcing side panel 97 has a width $W_7$ that is greater than $W_5$ and less than $W_6$. Moreover, in the exemplary embodiment, width $W_3$ is substantially equal to a sum of widths $W_5$, $W_6$, and $W_7$, and width $W_4$ is substantially equal to a sum of widths $W_5$ and $W_6$.

First and second end panels 110 and 130, respectively, each have a height $H_2$ and first and second foldover panels 112 and 132, respectively, each have a height $H_3$ that is substantially equal to width $W_7$. A sum of height $H_2$ and height $H_3$ is substantially equal to height $H_1$. Moreover, each of first and second side panels 54 and 60, respectively, has a height $H_4$ that is substantially equal to height $H_2$ of first and second end panels 110 and 130, respectively. Further, in the exemplary embodiment, inner and outer reinforcing panel assemblies 82 and 80, respectively, have a height $H_5$ that is substantially similar to height $H_4$ of first and second side panels 54 and 60, respectively.

Figure 2:
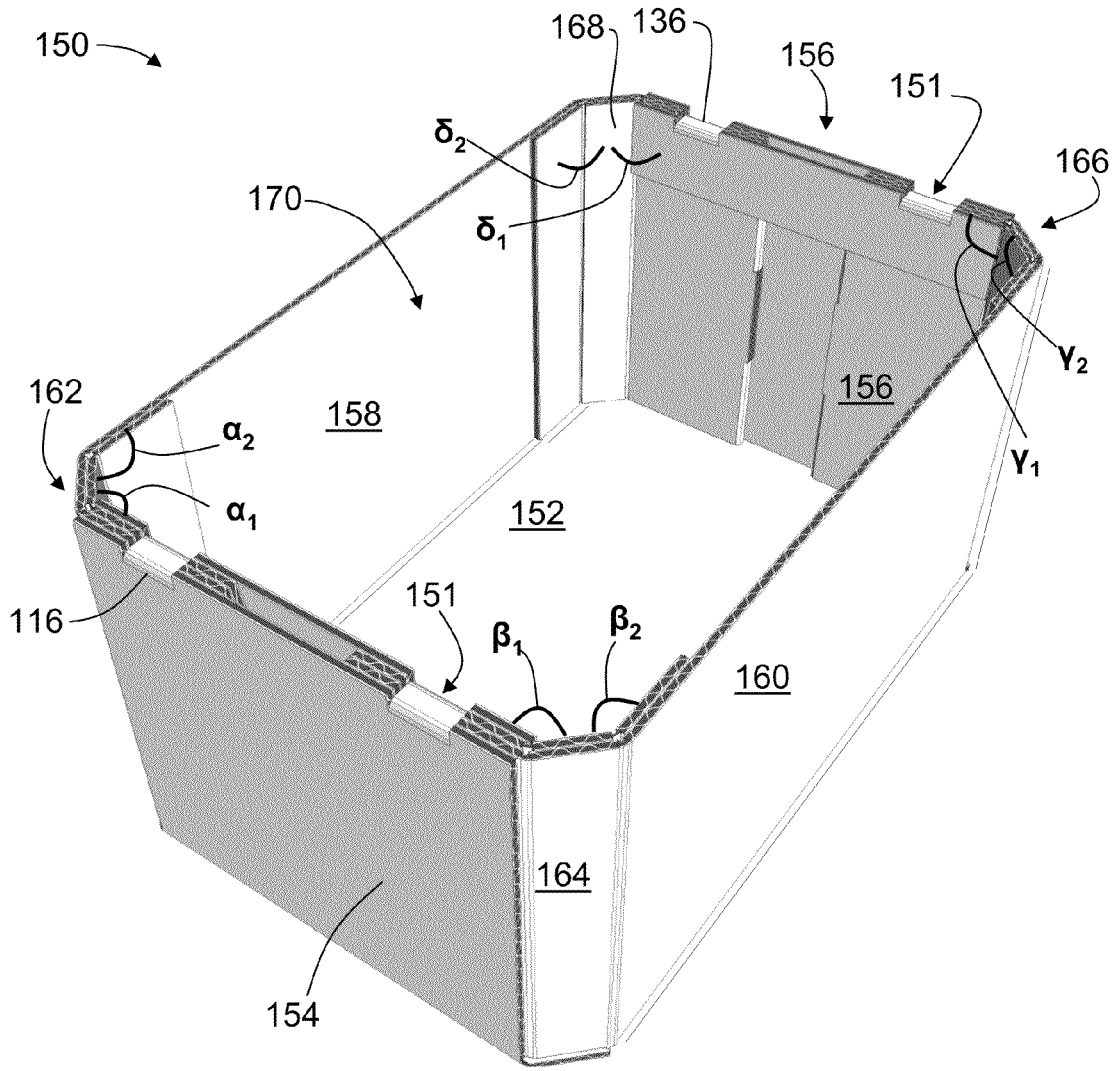
FIG. 2 is a perspective view of a container formed from the blank shown in FIG. 1.

FIG. 2 is a perspective view of container 150 that is formed from blank 10 (shown in FIG. 1). Although container 150 is shown as being formed without a product to be contained therein, container 150 may also be formed having a product therein. Further, container 150 may include any suitable number of products of any suitable shape. In the exemplary embodiment, bottom panel 22 is sized to correspond to product(s) contained within container 150.

Container 150 may be formed by hand from blank 10. Container 150 is formed by erecting and positioning the panels of blank 10 into an erect or formed position. Container 150 may be held or locked into the formed position without the use of glue or adhesives for adhering one panel to another panel.

More specifically, inner reinforcing side panel 97 and respective inner reinforcing panel assembly 82 are folded about fold line 86 such that inner reinforcing panel assembly 82 and outer reinforcing panel assembly 80 are in an at least partially overlying relationship, and such inner reinforcing side panel 97 is in an at least partially overlying relationship with at least a portion of first or second side panel 54 or 60, respectively. As used herein, an at least partially overlaying relationship exists when a first panel is extending in a plane that is substantially parallel to the plane of a second panel such that the first and second panels obscure a portion of each other. Moreover, the panels do not have to be in contact with each other and a third panel may be positioned therebetween.

Also, more specifically, blank 10 is folded along fold line 86 such that outer reinforcing corner panel 90 and inner reinforcing corner panel 94 are substantially aligned in an at least partially overlying relationship, outer and inner reinforcing end panels 92 and 96, respectively, are substantially aligned in an at least partially overlying relationship, and inner reinforcing side panel 97 and at least a portion of first or second side panel 54 or 60, respectively, are substantially aligned in an at least partially overlying relationship. Cutouts 106 defined in overlying outer and inner reinforcing end panels 92 and 96, respectively, are substantially aligned, thereby forming a locking slot 151.

In the exemplary embodiment, inner reinforcing side panel 97, a respective side panel 54 or 60, reinforcing end panels 92 and 96, and/or outer reinforcing corner panel 90 and inner reinforcing corner panel 94 can be secured by hand and without adhesives in the above-described relationships. For example, inner reinforcing side panel 97, a respective side panel 54 or 60, reinforcing end panels 92 and 96, and/or corner panel 90 and inner reinforcing corner panel 94 are held by a force applied by the person erecting container 150 on exterior surface 14 as container 150 continues to be erected. Also, in the exemplary embodiment, no adhesives are used to assemble container 150. Alternatively, small amounts of adhesive are used to assemble container 150.

Reinforcing panel assemblies 80 and 82 are rotated about fold lines 70, 72, 74, and 76. Further, reinforcing end panels 92 and 96 are rotated about fold lines 102 and 104 toward corner panels 90 and 94 before or after reinforcing panel assemblies 80 and 82 are rotated about fold lines 70, 72, 74, and 76. In the exemplary embodiment, reinforcing panel assemblies 80 and 82 and reinforcing end panels 92 and 96 are rotated such that reinforcing end panels 92 and 96 are substantially perpendicular to side panels 54 and 60. First and second side panels 54 and 60, respectively, are then rotated about fold lines 56 and 62, respectively, toward interior surface 12.

Front panel assembly 20 is rotated about fold line 26 toward interior surface 12, and rear panel assembly 24 is rotated about fold line 28 toward interior surface 12. More specifically, front panel assembly 20 and rear panel assembly 24 are rotated to be substantially perpendicular to bottom panel 22, as shown in FIG. 2.

First foldover panel 112 is rotated about fold line 114 toward first end panel 110 such that first foldover panel 112 and first end panel 110 are substantially aligned in an at least partially overlying relationship. Moreover, each of first hinge tabs 116 is disposed or inserted within locking slot 151 to define an interference, or friction fit therein. Locking each first hinge tab 116 within locking slot 151 facilitates securing front panel assembly 20 to reinforcing panel assembly 68 and, indirectly to side panels 54 or 60. In the exemplary embodiment, no adhesives are used to assembly container 150. Alternatively, small amounts of adhesive are used to assembly container 150.

Similarly, second foldover panel 132 is rotated about fold line 134 toward second end panel 130 such that second foldover panel 132 and second end panel 130 are substantially aligned in an at least partially overlying relationship. Moreover, each of second hinge tabs 136 is disposed or inserted within locking slot 151 to define an interference, or friction fit therein. Locking each second hinge tab 136 within locking slot 151 facilitates securing front panel assembly 20 to reinforcing panel assembly 68 and, indirectly to side panels 54 or 60. Therefore, hinge tabs 116 lock container 150 in a formed position. In the exemplary embodiment, no adhesives are used to assembly container 150. Alternatively, small amounts of adhesive are used to assembly container 150.

When container 150 is formed, interior surface 12 of front and rear panel assemblies 20 and 24 is adjacent the side walls of the product. Further, height $H_2$ of first and second end panels 110 and 130, respectively, is sized to correspond to a height of the products within container 150 such that height $H_2$ is substantially equal to or greater than the height of the products. Bottom panel 22 forms a bottom wall 152 of container 150, first end panel 110 and a pair of reinforcing end panels 92 and 96 forms a front wall 154 of container 150, and second end panel 130 and a pair of reinforcing end panels 92 and 96 forms a rear wall 156 of container 150. In the exemplary embodiment, opposing pairs of overlying reinforcing end panels 92 and 96 associated with each of walls 154 and 156 do not extend to completely overlie interior surface 12 of first and second end panels 110 and 130, respectively. Therefore, in the exemplary embodiment, at least a portion of interior surface 12 of end panels 110 and 130 is exposed.

Front wall 154 and rear wall 156 are also referred to as end walls of container 150. First side panel 54 and two inner reinforcing side panels 97 form a first side wall 158, and side panel 60 and two inner reinforcing side panels 97 form a second side wall 160. Each pair of reinforcing corner panels 90 and 94 forms first corner wall 162, second corner wall 164, third corner wall 166, and fourth corner wall 168. Bottom wall 152, front wall 154, rear wall 156, first side wall 158, second side wall 160, and corner walls 162, 164, 166, and 168 define a cavity 170 of container 150.

In the exemplary embodiment, first corner wall 162 is oriented at an oblique angle $\alpha_1$ to front wall 154 and an oblique angle $\alpha_2$ to side wall 158. Similarly, second corner wall 164 is oriented at an oblique angle $\beta_1$ to front wall 154 and an oblique angle $\beta_2$ to side wall 160. Similarly, third corner wall 166 is oriented at an oblique angle $\gamma_1$ to rear wall 156 and an oblique angle $\gamma_2$ to side wall 160, and fourth corner wall 168 is oriented at an oblique angle $\delta_1$ to rear wall 156 and an oblique angle $\delta_2$ to side wall 158. In the exemplary embodiment, angles $\alpha_1$, $\alpha_2$, $\beta_1$, $\beta_2$, $\gamma_1$, $\gamma_2$, $\delta_1$, and $\delta_2$ are substantially equal, however, angles $\alpha_1$, $\alpha_2$, $\beta_1$, $\beta_2$, $\gamma_1$, $\gamma_2$, $\delta_1$, and/or $\delta_2$ can be other than equal depending of the products positioned within container 150. Further, in the exemplary embodiment, bottom edges 78 of reinforcing panels 68 are substantially aligned with fold lines 26, 28, 56, and 62 and angled edges 30, 32, 34, and 36. Container 150 has a configuration referred to herein as an "open configuration."

In the exemplary embodiment, container 150 is hand formed. Alternatively, the above-described method to construct container 150 from blank 10 may be at least partially performed using a machine. In the example embodiment, each of the reinforcing corner assemblies forms a reinforced corner of container 150. In other words, the end panels form end walls, the side panels form side walls, and the reinforced corner assemblies form reinforced corners including corner walls resulting in an eight sided container 150. The reinforced corners include locking slots positioned adjacent to each of the end walls for receiving the hinge tabs of the foldover panels for locking the container in the formed position.

Figure 3:
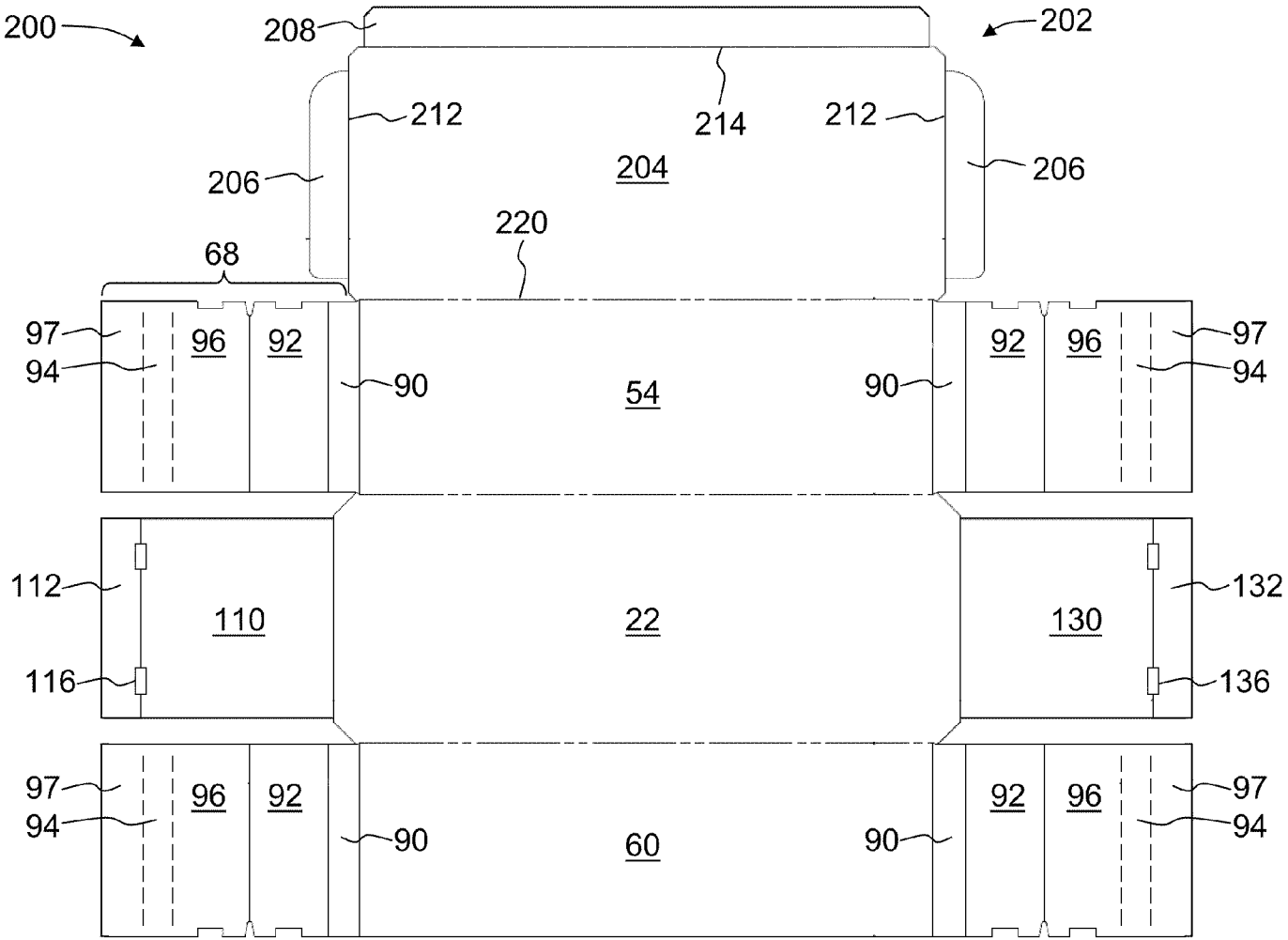
FIG. 3 is a top plan view of a blank of sheet material for constructing a container according to a second embodiment of the present invention.

FIG. 3 is a top plan view of a blank 200 of sheet material for constructing a container according to a second embodiment of the present invention. Blank 200 is essentially similar to blank 10 (shown in FIG. 1) and, as such, similar components are labeled with similar references. More specifically, blank 200 includes a top cover assembly 202.

In the exemplary embodiment, top cover assembly 202 includes a center panel 204. Top cover assembly 202 further includes two opposing side panels 206, each side panel extending from a fold line 212 of center panel 204. Top cover assembly 202 includes a front panel 208 extending from a fold line 214 of center panel 204. Center panel 204 extends from a fold line 220, which is also a top edge of side panel 54.

A container essentially similar to container 150 (shown in FIG. 2) is formed from blank 200. In the exemplary embodiment, the container formed from blank 200 includes top cover assembly 202. To construct the container from blank 200, a method that is substantially similar to the method for forming container 150 from blank 10 is used. By forming top cover assembly 202 of the container, the container is considered to be in a "closed configuration" rather than the "open configuration" of container 150 (shown in FIG. 2). The container may be formed by hand from blank 200 by erecting and positioning the panels of blank 200 into an erect or formed position. Alternatively, the method to construct the container from blank 200 may be at least partially performed using a machine. The container may be held or locked into the formed position without the use of glue or adhesives for adhering one panel to another panel. In the exemplary embodiment, no adhesives are used to assemble the container. Alternatively, small amounts of adhesive are used to assemble the container. In the case where no adhesive is used to construct the container from blank 200, front panel 208 and side panels 206 are tucked inside the container to hold top cover assembly 202 in the closed configuration. In the case where an adhesive is used, front panel 208 and side panels 206 may be glued to side panel 60 and end panels 110 and 130, respectively, to hold the container in the closed configuration.

To close the container and form top cover assembly 202, two opposing side panels 206 are rotated about fold lines 212 and front panel 208 is rotated about fold line 214 towards center panel 204 such that side panels 206 and front panel 208 are substantially perpendicular to center panel 204. Further, top cover assembly 202 is rotated about fold line 220 to be substantially parallel to bottom panel 22 and positioned adjacent the top edges of the container. Center panel 204, two opposing side panels 206, and front panel 208 form top cover assembly 202 of the container.

The above-described blanks and container provide a reinforcing polygonal container. More specifically, the embodiments described herein provide an octagonal container having reinforced corner walls, side walls, and end walls for storing and/or transporting a product therein. Further, the embodiments described herein provide a polygonal container having a plurality of hinge tabs. More specifically, a plurality of hinge tabs may be defined with cut lines and fold lines and such hinge tabs become prominent as an associated foldover panel is rotated toward an associated end panel. The hinge tabs are inserted into cutouts defined within adjacent reinforcing panels such that portions of the container are locked into position.

Exemplary embodiments of a container formed to contain a product therein and blanks for making the same are described above in detail. The blanks and the container are not limited to the specific embodiments described herein, but rather, components of the blanks and/or the container may be utilized independently and separately from other components described herein. For example, the blanks may also be used in combination with other types of product, and is not limited to practice with only the cylindrical products, as described herein. Rather, the exemplary embodiments can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A blank of sheet material for forming a polygonal container, said blank comprising:

a bottom panel, the bottom panel having at least one side edge, at least one end edge, and at least one angled edge interposed between the at least one side edge and the at least one end edge, the at least one angled edge having a first length;

two opposing side panels, each side panel extending from a side edge of the bottom panel;

two opposing end panels, each end panel extending from an end edge of the bottom panel;

a first foldover panel extending from a top edge of a first end panel of the two end panels, the first foldover panel configured to lock the container in at least a partially formed position;

a reinforcing panel assembly extending from a first side edge of a first side panel of the two side panels, the reinforcing panel assembly comprising:

an outer reinforcing corner panel extending from the first side edge of the first side panel, the outer reinforcing corner panel having a first width substantially equal to the first length, the outer reinforcing corner panel having a first height;

an outer reinforcing end panel extending from a side edge of the outer reinforcing corner panel;

an inner reinforcing end panel extending from a side edge of the outer reinforcing end panel;

an inner reinforcing corner panel extending from a side edge of the inner reinforcing end panel, the inner reinforcing corner panel having a second width substantially equal to the first length, the inner reinforcing corner panel having a second height substantially equal to the first height; and an inner reinforcing side panel extending from a side edge of the inner reinforcing corner panel.

2. A blank in accordance with claim 1, wherein the bottom panel is octagonal-shaped.

3. A blank in accordance with claim 1 further comprising a plurality of reinforcing panel assemblies, wherein each side panel comprises one reinforcing panel assembly of the plurality of reinforcing panel assemblies extending from opposing side edges thereof.

4. A blank in accordance with claim 1 further comprising a second foldover panel extending from a top edge of a second end panel of the two end panels, the first and second foldover panels configured to lock the container in a formed position.

5. A blank in accordance with claim 1 further comprising at least one hinge tab connecting the first foldover panel to the first end panel.

6. A blank in accordance with claim 1, wherein the outer reinforcing end panel comprises a first cutout defined along a top edge thereof; and the inner reinforcing end panel comprises a second cutout defined along a top edge thereof;

wherein the first cutout aligns with the second cutout to form a locking slot when the inner reinforcing end panel is folded inwardly in a face-to-face relationship with the outer reinforcing end panel.

7. A blank in accordance with claim 6 further comprising at least one hinge tab connecting the first foldover panel to the first end panel, wherein the locking slot is configured to receive the at least one hinge tab for locking the container in at least a partially formed position when the first foldover panel is folded inwardly in an at least partially overlying relationship with the first end panel.

8. A blank in accordance with claim 1 further comprising:

a plurality of reinforcing panel assemblies, wherein each side panel comprises one reinforcing panel assembly of the plurality of reinforcing panel assemblies extending from opposing side edges thereof; and a second foldover panel extending from a top edge of a second end panel of the two end panels, the first and second foldover panels each having a pair of hinge tabs;

wherein each of the reinforcing panel assemblies comprises an outer reinforcing end panel having a first cutout defined along a top edge thereof, and an inner reinforcing end panel having a second cutout defined along a top edge thereof, wherein each of the respective first and second cutouts align to form locking slots when the container is fully erect.

9. A blank in accordance with claim 8 wherein each locking slot is configured to receive a corresponding hinge tab of two pairs of hinge tabs for locking the container in a formed position when the first and second foldover panels are each folded inwardly in an at least partially overlying relationship with at least one of the first and second end panels.

10. A blank in accordance with claim 1, wherein the container is formed without using any adhesive for adhering one panel to another.

11. A polygonal container formed from a blank of sheet material, said container comprising:

a bottom wall, the bottom wall having at least one side edge, at least one end edge, and at least one angled edge interposed between the at least one side edge and the at least one end edge, the at least one angled edge having a first length;

two opposing side walls, each side wall emanating from a side edge of the bottom wall;

two opposing end walls, each end wall comprising an end panel and a foldover panel, each end wall emanating from an end edge of the bottom wall, each foldover panel opposite the end edge and configured to lock the container in at least a partially formed position; and a first reinforcing panel assembly extending between a first end wall of the two end walls and a first side wall of the two side walls, the first reinforcing panel assembly comprising:

a corner panel emanating from a side edge of the first side wall, the corner panel having a first width substantially equal to the first length, the corner panel having a first height;

a first reinforcing end panel emanating from a side edge of the corner panel;

a second reinforcing end panel emanating from a side edge of the first reinforcing end panel; and an inner reinforcing corner panel emanating from a side edge of the second reinforcing panel, the inner reinforcing corner panel having a second width substantially equal to the first length, the inner reinforcing corner panel having a second height substantially equal to the first height, wherein the corner panel and the inner reinforcing corner panel are disposed in juxtaposed face-to-face relation to one another to form a corner wall extending from an end edge of the first side wall to an end edge of the first end wall.

12. A polygonal container in accordance with claim 11, further comprising:

a second reinforcing panel assembly extending between the first end wall and a second side wall of the two side walls;

a third reinforcing panel assembly extending between a second end wall of the two end walls and the second side wall; and a fourth reinforcing panel assembly extending between the second end wall and the first side wall.

13. A polygonal container in accordance with claim 11, wherein the first reinforcing panel assembly further comprises an inner side panel at least partially overlying the first side wall.

14. A polygonal container in accordance with claim 11, further comprising at least one hinge tab connecting a first foldover panel of the two foldover panels to a first end panel of the two end panels.

15. A polygonal container in accordance with claim 11, wherein each of the two opposing end walls further comprises a pair of hinge tabs for connecting respective foldover panels to respective end panels.

16. A polygonal container in accordance with claim 11, wherein the first reinforcing end panel includes a first cutout defined along a top edge thereof, the second reinforcing end panel includes a second cutout defined along a top edge thereof, the second reinforcing end panel at least partially overlies the first reinforcing end panel, and the first cutout is aligned with the second cutout to form a locking slot.

17. A polygonal container in accordance with claim 11, further comprising:

a fourth reinforcing panel assembly extending between the second end wall and the first side wall, wherein the fourth reinforcing panel assembly includes a first reinforcing end panel having a first cutout defined along a top edge thereof that at least partially overlies a second reinforcing end panel having a second cutout defined along a top edge thereof, the first and second cutouts aligned to form an opposing pair of locking slots.

18. A polygonal container in accordance with claim 17, wherein each of the two opposing end walls further comprises at least one hinge tab, each of the pair of locking slots receives one of the hinge tabs, the foldover panels folded inwardly to at least partially overlie at least one of the first and fourth reinforcing panel assemblies.

19. A polygonal container in accordance with claim 11, further comprising:

a second reinforcing panel assembly extending between the first end wall and a second side wall of the two side walls;

a third reinforcing panel assembly extending between a second end wall of the two end walls and the second side wall; and a fourth reinforcing panel assembly extending between the second end wall and the first side wall, wherein each of the pair of foldover panels has a pair of hinge tabs, and wherein each of the second, third and fourth reinforcing panel assemblies comprises a first reinforcing end panel at least partially overlying a second reinforcing end panel, each of the first and second reinforcing end panels defining a locking slot along a top edge of the respective end walls.

20. A polygonal container in accordance with claim 19, wherein each locking slot is configured to receive a corresponding hinge tab of the two pairs of hinge tabs for locking the container in a formed position, the pair of foldover panels folded inwardly in at least a partially overlying relationship with at least one of the reinforcing panel assemblies.

21. A polygonal container in accordance with claim 11, wherein the container is formed without using any adhesive for adhering any one panel to any other panel.

22. A method for forming a polygonal container from a blank of sheet material, the polygonal container including at least five sides, the method comprising:

(a) providing the blank having:

a bottom panel having two side edges, two end edges, and at least one angled edge interposed between at least one side edge and at least one end edge, the at least one angled edge having a first length;

two opposing side panels each extending from a respective side edge of the bottom panel;

two opposing end panels each extending from a respective end edge of the bottom panel;

a first foldover panel extending from a top edge of a first end panel of the two end panels; and a reinforcing panel assembly extending from a first side edge of a first side panel of the two side panels, wherein the reinforcing panel assembly includes:

an outer reinforcing corner panel extending from the first side edge of the first side panel, the outer reinforcing corner panel having a first width substantially equal to the first length, the outer reinforcing corner panel having a first height;

an outer reinforcing end panel extending from a side edge of the outer reinforcing corner panel;

an inner reinforcing end panel extending from a side edge of the outer reinforcing end panel;

an inner reinforcing corner panel extending from a side edge of the inner reinforcing end panel, the inner reinforcing corner panel having a second width substantially equal to the first length, the inner reinforcing corner panel having a second height substantially equal to the first height; and an inner reinforcing side panel extending from a side edge of the inner reinforcing corner panel;

(b) rotating the inner reinforcing end panel toward an interior surface of the outer reinforcing end panel about a fold line connecting the inner reinforcing end panel and the outer reinforcing end panel, wherein the outer reinforcing end panel includes a first cutout defined along a top edge thereof and the inner reinforcing end panel includes a second cutout defined along a top edge thereof, wherein said rotating aligns the first cutout and the second cutout to form a locking slot;

(c) rotating the outer and inner reinforcing end panels toward an interior surface of the first side panel about a fold line connecting the inner reinforcing end panel and the inner reinforcing corner panel and about a fold line connecting the outer reinforcing end panel and the outer reinforcing corner panel;

(d) rotating the outer reinforcing corner panel and the inner reinforcing corner panel toward the interior surface of the first side panel about a fold line connecting the inner reinforcing corner panel and the inner reinforcing side panel and about a fold line connecting the outer reinforcing corner panel and the first side panel; and (e) rotating the first side panel inwardly into a substantially perpendicular relationship with the bottom panel about a fold line connecting the first side panel and the bottom panel, the first side panel and inner reinforcing side panel forming a first side wall of the polygonal container and the outer reinforcing corner panel and the inner reinforcing corner panel forming a first corner wall of the polygonal container.

23. A method in accordance with claim 22 further comprising:

rotating a first end panel of the two end panels inwardly into a substantially perpendicular relationship with the bottom panel; and attaching an interior surface of the first end panel to an exterior surface of the outer reinforcing end panel, the first end panel and the outer and inner reinforcing end panels forming a first end wall of the polygonal container.

24. A method in accordance with claim 23 wherein the outer reinforcing end panel and the inner reinforcing end panel each includes a cutout for forming a locking slot, and wherein the first foldover panel includes a hinge tab, and wherein the method further comprises:

rotating the first foldover panel inwardly in at least a partially overlying relationship with the reinforcing panel assembly; and inserting the hinge tab into the locking slot to lock the container in a formed position.

25. A method for forming a polygonal container from a blank of sheet material, the polygonal container including eight walls, the method comprising:

(a) providing the blank having:

a bottom panel having two side edges, two end edges, and four angled edges each interposed between one of the two side edges and one of the two end edges, each angled edge having a first length;

two opposing side panels each extending from a side edge of the bottom panel, two opposing end panels each extending from an end edge of the bottom panel, a first foldover panel extending from a top edge of a first end panel of the two end panels, a second foldover panel extending from a top edge of a second end panel of the two end panels, and a pair of reinforcing panel assemblies extending from opposing side edges of each of the two opposing side panels for forming reinforced corners, wherein each reinforcing panel assembly includes:

an outer reinforcing corner panel extending from the first side edge of the respective side panel, the outer reinforcing corner panel having a first width substantially equal to the first length, the outer reinforcing corner panel having a first height;

an outer reinforcing end panel extending from a side edge of the outer reinforcing corner panel;

an inner reinforcing end panel extending from a side edge of the outer reinforcing end panel; and an inner reinforcing corner panel extending from a side edge of the inner reinforcing end panel, the inner reinforcing corner panel having a second width substantially equal to the first length, the inner reinforcing corner panel having a second height substantially equal to the first height;

(b) forming each of the reinforced corners from the reinforcing panel assemblies such that the outer reinforcing corner panel and the inner reinforcing corner panel of each reinforcing panel assembly are disposed in a face-to-face relationship to form each reinforced corner, each of the reinforcing corners including a locking slot;

(c) rotating the side panels inwardly into a substantially perpendicular relationship with the bottom panel for forming the side walls;

(d) rotating the end panels inwardly into a substantially perpendicular relationship with the bottom panel for forming the end walls;

(e) positioning the locking slots adjacent to the end walls;

(f) rotating the first and second foldover panels inwardly in at least a partially overlying relationship with at least one of the reinforcing panel assemblies, wherein each of the foldover panels includes a pair of hinge tabs; and (g) inserting the hinge tabs of the foldover panels into the locking slots to lock the container in a formed position.

* * * * *